United States Patent [19]

Kobylarz

[11] 3,979,857

[45] Sept. 14, 1976

[54] RAZOR BLADE SHARPENER

[75] Inventor: John R. Kobylarz, Wallington, N.J.

[73] Assignee: The Raymond Lee Organization, Inc., New York, N.Y. ; a part interest

[22] Filed: Sept. 15, 1975

[21] Appl. No.: 613,123

[52] U.S. Cl. ..... 51/109 BS; 51/125; 51/170 T; 51/173

[51] Int. Cl.[2] ..... B24B 3/50

[58] Field of Search ..... 51/109 BS, 125, 125.5, 51/170 T, 173, 218 R, 218 P

[56] References Cited

UNITED STATES PATENTS

| | | | |
|---|---|---|---|
| 1,614,492 | 1/1927 | Rhodes | 51/109 BS X |
| 1,644,778 | 10/1927 | Gibson | 51/109 BS X |
| 1,956,686 | 5/1934 | Kane | 51/125.5 |

*Primary Examiner*—Al Lawrence Smith
*Assistant Examiner*—James G. Smith

[57] ABSTRACT

A case is formed by a rectangular base and a rectangular lid that is hingedly attached to the base. Flush with the top surface of the base is an abrasive disc that can be rotated by a knob underneath the base. A double-edged razor blade can be put into a recess in the lid. A strip of flexible material bears against a razor blade so placed when the lid and base are closed together. The recess in the lid and the strip cooperate to urge one side of one edge of the blade against the disc when the lid and base are closed. The knob may then be turned to sharpen the blade.

3 Claims, 4 Drawing Figures

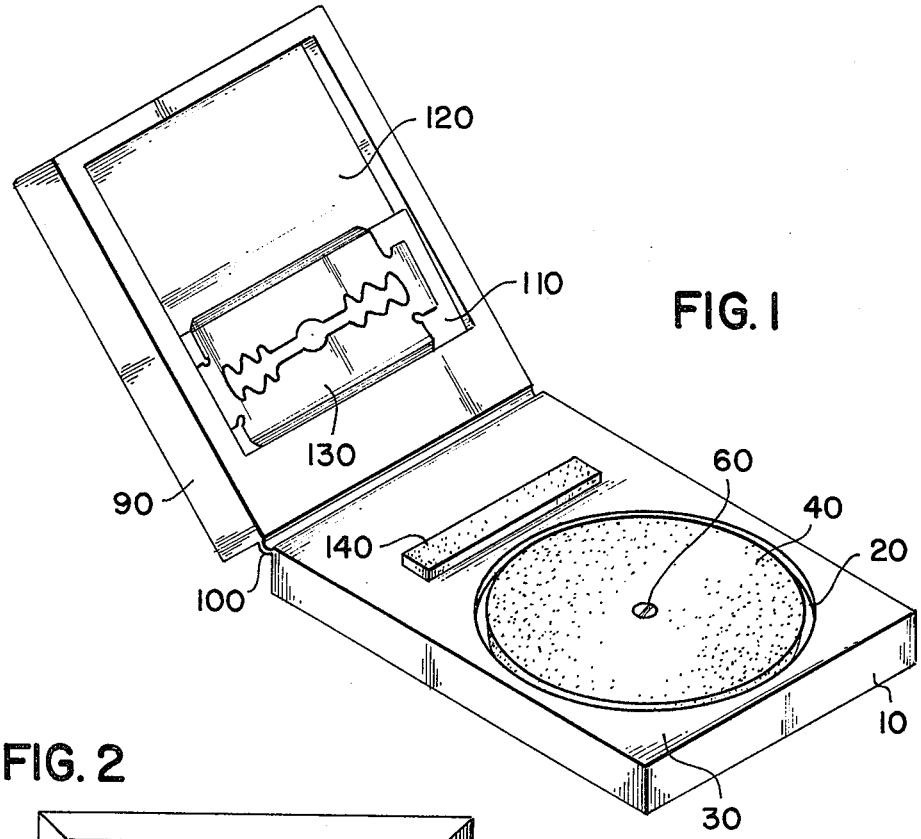
FIG. 1
FIG. 2
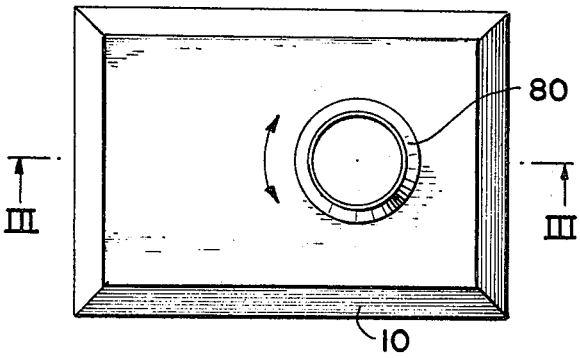
FIG. 3
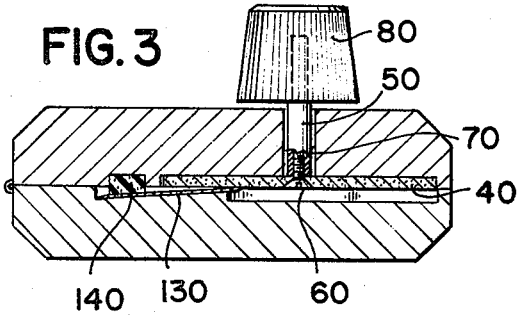
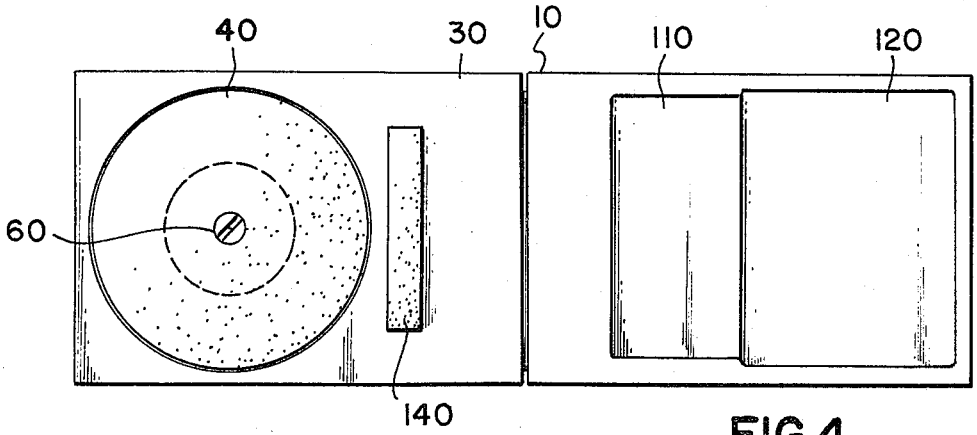
FIG. 4

RAZOR BLADE SHARPENER

SUMMARY OF THE INVENTION

This invention is a device that is designed to sharpen razor blades easily and also to be compact and inexpensive to produce. The invention has a case formed by a base and a lid hingedly attached together. The parts are so designed that when a double-edged razor blade is placed in the lid and the case is closed, one side of one edge of the blade is brought to bear against an abrasive disc located in the base. The disc may then be rotated by means of a knob to sharpen the blade.

BRIEF DESCRIPTION OF THE DRAWINGS

FIG. 1 is a view of the invention in an open state with a blade mounted in it.

FIG. 2 is a bottom view of the invention.

FIG. 3 is a view along line III—III of FIG. 2.

FIG. 4 is a view of the invention in an open state.

DETAILED DESCRIPTION OF THE PREFERRED EMBODIMENT

A base 10 is rectangular in shape, and has a circular recess 20 in its top surface 30. In this recess is located an abrasive disc 40. The disc is attached at its center to one end of an axle 50 by a screw 60. The axle extends downwardly through the base in hole 70 that intersects the center of recess 20. The axle extends through the base to be attached to a knob 80 located below the base. Th disc can thus be turned by rotating the knob by hand.

A lid 90 is like the base in exterior appearance, and is hinged to one edge of the base by hinge 100.

Into the lid are cut two rectangular recesses 110 and 120. Recess 110 extends transversely across the lid and is generally the shape and size of a conventional double-edged razor blade 130. The bottom of recess 110 slants downwardly as the hinge is approached. The other access 120 has a flat bottom, and is cut into the lid only to insure that the disc will have room to rotate freely.

An elongated strip 140 of flexible form rubber or the like extends transversely across the top surface of the base, between the wheel and the hinge. This strip is so located that the blade is pushed flush against the bottom of recess 110 when the lid and base are closed together. As can be seen, the bottom surface of the recess 110 causes one side of one edge of th blade to bear against the top surface of the disc when the lid and base are closed. The blade can then be sharpened by rotating the knob.

It is to be noted that the bottom surface of the disc is not coated with abrasive as the top surface is. This prevents abrasion of the bottom of recess 20.

I claim:

1. A device for sharpening razor blades, comprising:

a flat rectangular base with a circular recess on its top surface and a hole extending downwardly through the base through the center of the recess;

an axle located in the hole and extending into the recess and below the base;

an abrasive disc attached at its center to the axle and rotating in the recess when the axle is rotated;

a knob attached to the end of the axle below the base;

a lid hingedly attached to the base in a manner that the base and lid form a rectangular box when closed together, the lid having a recess located in its bottom surface; and means cooperating with the recess in the lid to urge one side of one of the edges of a razor blade against the abrasive disc when the blade has been placed in the recess in the lid and the lid is closed together with the base.

2. The device of claim 1 wherein the recess in the lid has a rectangular shape and extends transversely across the lid.

3. The device of claim 2 wherein the means comprises a transversely extending strip of flexible material located on the top surface of the base and bearing against a razor blade placed in the recess in the lid when the lid is closed.

* * * * *